United States Patent [19]

Seitel

[11] 4,146,278

[45] Mar. 27, 1979

[54] DISPENSING DISPLAY CASE

[76] Inventor: William Seitel, 92 Argyle Rd., Brooklyn, N.Y. 11218

[21] Appl. No.: 861,299

[22] Filed: Dec. 16, 1977

[51] Int. Cl.[2] ..... A47F 1/00

[52] U.S. Cl. ..... 312/35; 312/42; 312/111; 312/323; 220/345

[58] Field of Search ..... 312/42, 35, 60, 313, 312/9, 12, 13, 231, 233, 204, 323; 220/345; 49/463, 453; 248/222.2, 73

[56] References Cited

U.S. PATENT DOCUMENTS

| | | | |
|---|---|---|---|
| 1,017,788 | 2/1912 | Murnin | 312/35 |
| 1,055,201 | 3/1913 | Mason | 248/222.2 |
| 1,078,372 | 11/1913 | Patterson | 312/35 |
| 2,761,498 | 9/1956 | Reinhardt | 49/453 |
| 3,208,809 | 9/1965 | Quimper | 220/345 |
| 3,350,152 | 10/1967 | Bang | 312/323 |
| 3,776,419 | 12/1973 | Zinkgraf et al. | 312/35 |
| 3,851,938 | 12/1974 | McCowan et al. | 312/111 |
| 3,887,106 | 6/1975 | Charlson et al. | 312/42 |
| 3,975,071 | 8/1976 | Quinn | 312/323 |
| 4,037,756 | 7/1977 | Jaquish | 312/42 |

*Primary Examiner*—Victor N. Sakran

[57] ABSTRACT

A display case of the type having at least one housing for receiving articles to be dispensed comprises a cover member that is guided for vertical movement in the plane of the face of the housing. Guiding members are configured to permit detachment of the cover member solely in response to movement of the cover member in a predescribed manner thereby preventing inadvertent detachment.

5 Claims, 7 Drawing Figures

FIG. 5
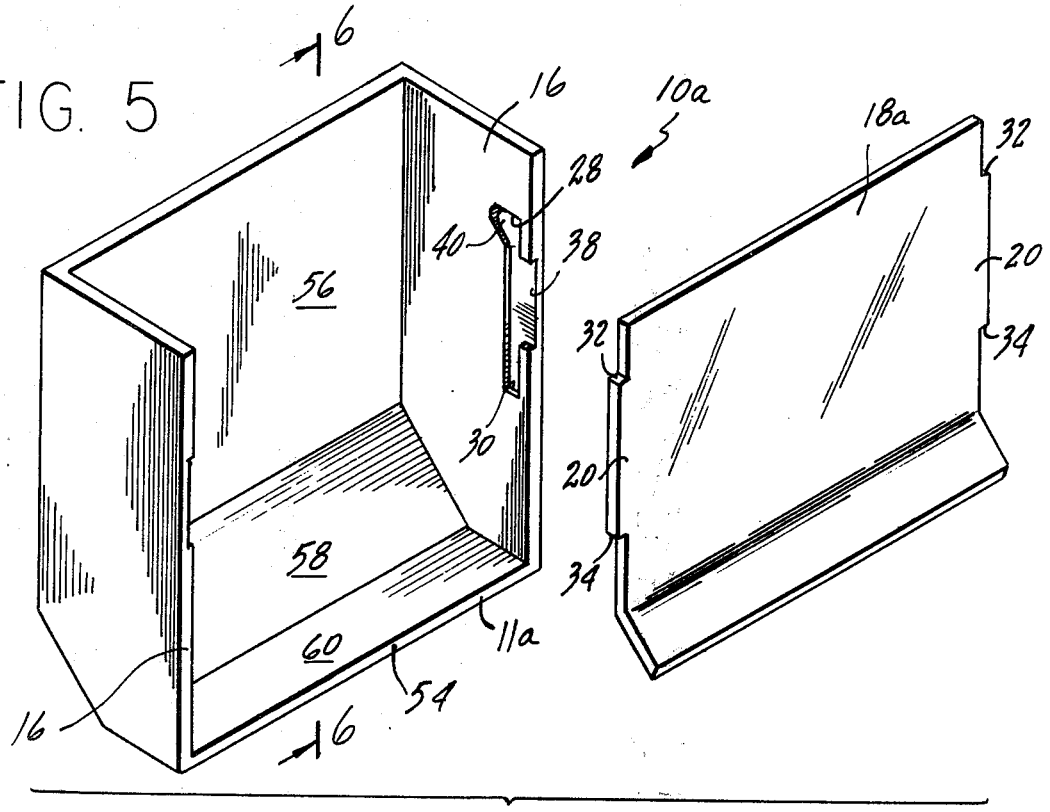
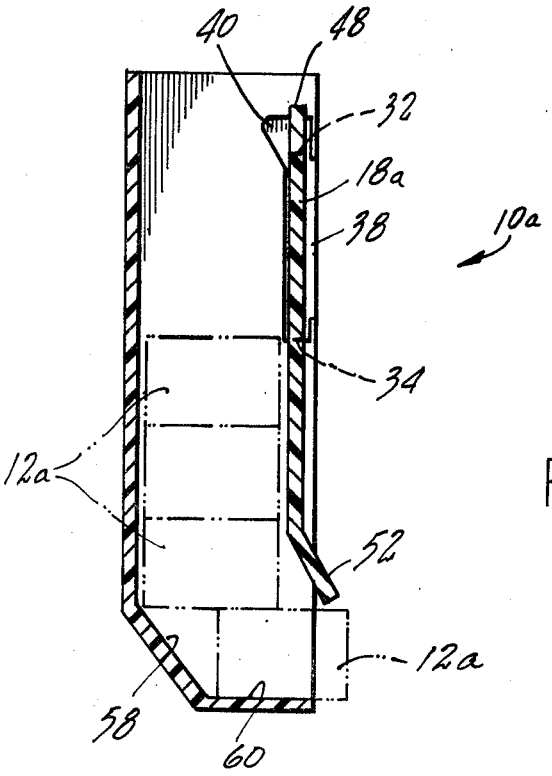
FIG. 6

DISPENSING DISPLAY CASE

BACKGROUND OF THE INVENTION

This invention relates to display cases for dispensing articles such as cosmetics.

One type of display case that is known comprises a cover member releasably detachable from a housing but in this device, the cover members can accidentally be separated from the housing by the user while attempting to manipulate same for dispensing an article.

This cover member is not designed to require angular displacement for detachment but only a simple translatory motion.

SUMMARY OF THE INVENTION

It is the principle object of this invention to provide a dispensing display case wherein the cover member can be quickly and easily detached therefrom by a deliberate action on the part of the user.

It is a further object to provide means for detaching said cover without the use of fasteners.

A still further object is to provide a simple, low cost construction for the cover member and housing and operable by a single movement for dispensing of articles without unintentionally detaching said cover member.

These and other objects are achieved by the preferred embodiment of the present invention in which a display case having at least one housing for receiving articles to be dispensed includes a cover member that is slideably mounted over the open front of the housing. The cover is releasably detachable from guides by first moving the cover member into an open position and then rotating the cover member to displace it from the plane of frontal opening.

Having in mind the above and other objects that will be obvious from an understanding of the disclosure, the present invention comprises a combination and arrangement of parts illustrated to the presently preferred embodiments of the invention which are hereinafter set forth in sufficient detail to enable those persons skilled in the art to clearly understand the function, operation, construction and advantage of it when read in conjunction with the accompanying drawing.

BRIEF DESCRIPTION OF THE DRAWING

The invention will be described in detail, by way of example, with reference to the accompanying drawing in which:

FIG. 5 is an exploded pictorial view of an alternative embodiment of the intention; and FIG. 6 is a side sectional view taken along line 6—6 in FIG. 5.

DETAILED DESCRIPTION OF THE INVENTION

Figure 1:
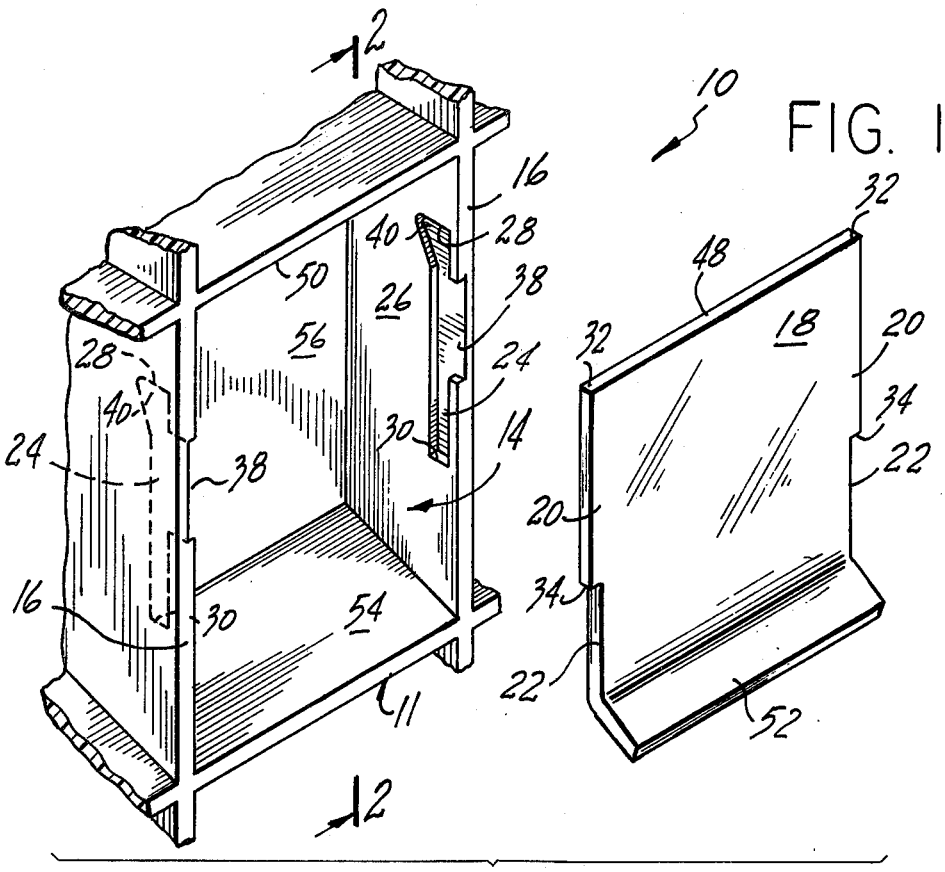
FIG. 1 is an exploded pictorial view of the preferred embodiment of the invention.
Figure 2A:
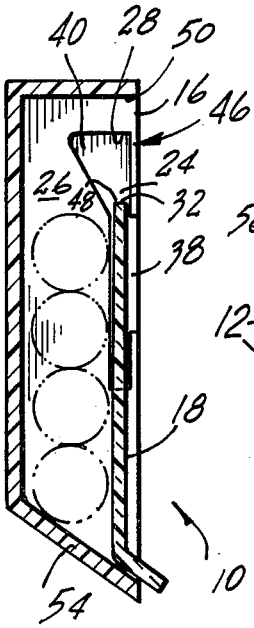
FIG. 2A is a side sectional view taken along line 2—2 in FIG. 1 showing the housing with the cover member in the lower position.
Figure 2B:
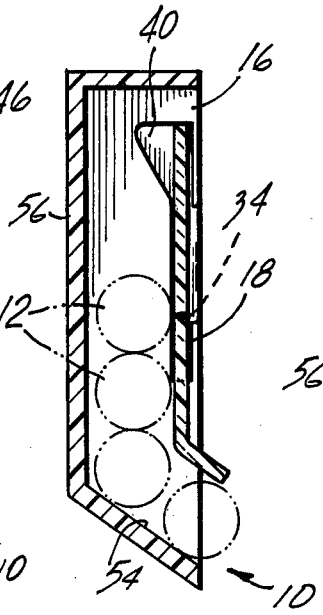
FIG. 2B is a side sectional view showing the housing with the cover member in the upper position.

Referring to FIGS. 1, 2A and 2B of the drawing and in accordance with the principles of the invention, a display case 10 having at least one housing 11 for articles 12 such as tubes of lipstick or the like is shown having a planar open front 14, side walls 16 and a substantially planar cover member 18 preferably comprising transparent plastic. The cover member 18 is guided to slideably move in the plane of the frontal opening 14 by means of a pair of tabs 20 each extending outwardly from parallel sides 22 of the cover member 18. The tabs 20 are preferably integral with the cover member 18 and are in the same plane. Each tab is receivable in one of a pair of elongated vertical grooves 24 formed into the facing surfaces 26 of the side walls 16 forming the housing 11. These facing surfaces 26 are parallel and spaced apart a given distance while the width of the cover member 18 as measured from the sides 22 is slightly less than the given distance.

The length of the grooves 24 from the highest point 28 to the lowest point 30 is greater than the length of the tabs 20 when measured from end points 32 and 34. The grooves 24 are cut to a given depth which, when added to the distance between the facing surfaces 26, exceeds the width of the cover member as measured over the ends of the tabs 20. The difference in length between the groove 24 and the tab 20 determines the amount of vertical movement of the cover member 18 installed into the housing 11.

The cover member 18, when mounted in the housing 11, is capable of sliding generally upwardly from a first or lower rest position as shown in FIG. 2A to an upper position defining a slot 36 through which one or more articles 12 in the housing 11 can be dispensed as shown in FIG. 2B.

Although the housing 11 is described as being in a vertical plane, this plane may deviate from the vertical since it is a component of the gravitational force which urges the articles 12 out of the housing 11 and will therefore be operative against an inclined plane.

The cover member 18 is releasably detachable from the housing 11 by moving the cover member 18 into the upper position, outwardly and angularly displacing it from the plane of the frontal opening 14 and then sliding it downwardly along the displaced plane. Separation of the cover member 18 from the housing movement can occur solely in response to the movement thus described and inadvertent detachment during normal dispensing use is thereby prevented.

Figure 3:
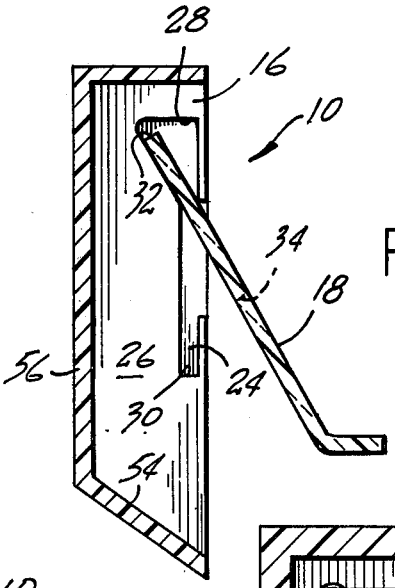
FIG. 3 is a side sectional view of the housing showing the cover member angularly displaced.

In order to allow the cover member 18 to assume the position for detachment, each groove 24 has a first portion 38 intermediate of the uppermost and lowermost portions 28, 30 that extends toward the frontal opening 14 and through the front edges of the side walls 16 as shown in FIG. 1. A second portion 40 of the groove 24 is formed into an enlarged area that is contiguous to the upper portion 28 of the groove 24 and is configured to permit the upper portion of the tab 20 to move rearwardly while the bottom of the cover member 18 moves forward to angularly dispose the cover member 18 after the cover 18 is first placed in the open position. Rotation into this oblique position as shown in FIG. 3 allows the bottom 34 of the tab 20 to move out of the groove 24 through the first portion 38 thereof and by pulling the cover member 18 downward at the rotated angle allows disengagement from the housing 11.

It should be noted that when the cover 18 is in the lower position (FIG. 2A) the upper portion 32 of the tab 20 extends above the highest point of the first portion 38 of groove 24, while when in the upper psition (FIG. 2B) the lower portion 34 of the tab 20 lies within the first portion 38.

Figure 4:
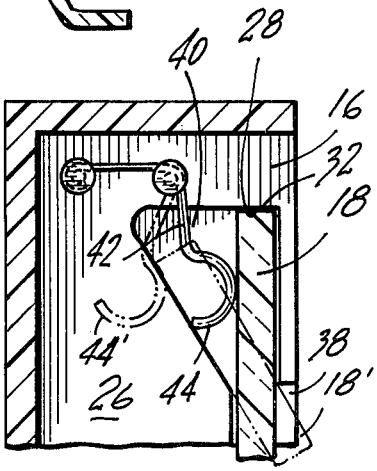
FIG. 4 is an enlarged view of the upper portion of the groove.

In order to further preclude accidental disengagement, the embodiment shown in FIG. 4 reveals a spring member 42 having a resilient portion 44 extending into each upper portion of the groove 24. The resilient portion 44 is configured to bear against the inside upper portion of the tabs 20 and bias the cover in the forward position.

In use, one must rotate the cover member 18 against the resisting force of the resilient portion 44 of spring 42 to set the cover in the oblique position 18' prior to removal.

In order to fill the housing 11 with the articles 12 to be dispensed, an opening 46 is defined in the lower position of the cover 18 between the top 48 of the cover member 18 and a top wall 50 of the housing 11. The housing also has a rear wall 56 and a bottom wall 54 disposed rearwardly upwardly in the housing to effect the dispensing of articles.

The bottom portion 52 of the cover member 18 is disposed at an oblique angle with respect to the plane of the cover in order to provide an easily accessible edge to the user for lifting and to guide the dispensed article 12 outward of the housing 11.

FIGS. 5 and 6 depict a display case **10*a* having a modified configuration for the housing 11*a* in which the bottom wall 54*a* includes an angularly positioned member 58 abutting a horizontally disposed member 60. This configuration of the housing 11*a* permits the dispensing of planar prismatic shaped articles 12*a* without necessitating the user to lift the cover 18*a* in order to effect the release of the article 12*a*. If the article 12*a* is not prone to roll, this embodiment of the housing 11*a*** is preferable.

While preferred and other exemplary embodiments of the invention are described, it will be understood that the invention is in no way limited to these embodiments.

What is claimed is:

1. In a display case of the type having at least one housing for receiving articles to be dispensed, said housing having a planar open front, side walls and a substantially planar cover member, wherein the improvement comprises:

means for guiding said cover member on the housing for sliding movement in the plane of the frontal opening from a first lower rest position to second generally upwardly disposed position; and means for effecting the releasable detachment of said cover member from the guide means solely in response to the movement of said cover member first into the upper position and then into a position that is outwardly angularly displaced from the plane of the opening;

wherein the releasable detachment means comprises means preventing outward angular displacement of the cover member when in the lower rest position to prevent inadvertent detachment of said cover member from the display during use wherein said side walls are disposed substantially parallel to each other and spaced apart a given distance and said cover member has a width less than said given distance, and wherein the means for guiding said cover member comprises a pair of elongated vertical grooves each having a given length and a given depth formed into the facing surfaces of said side walls and a tab extending outwardly from each side of said cover member and rigidly affixed thereto, wherein the distance between the ends of said tabs is greater than said given distance and wherein the length of each tab is less than the length of said groove with each of said tabs receivable in one thereof for guiding said cover member in a vertical direction for movement limited to the difference between the length of said groove and the length of said tab, said releasable detaching means comprising a first portion of each of said grooves disposed intermediate of the uppermost and lowermost portions thereof and extending forward through the front edge of each of said side walls and further comprises a second portion disposed contiguous to the upper portion of each of said grooves wherein said first and second portions are formed to said given depth and configured to permit the upper portion of each of said tabs to be angularly disposed by rotating rearwardly while the lower portion is permitted to rotate forwardly to dispose said tabs obliquely with respect to the vertical plane wherein downward displacement of said cover member in the oblique plane allows for the disengagement of said cover member from said housing, wherein the detaching means further comprises a spring member extending into the second portion of each groove and configured to bear against the inner upper portion of said tab for biasing same in a forward direction for resisting the rotation of said cover member to the oblique plane thereby preventing accidental disengagement of said cover member.

2. The display case as recited in claim 1, wherein the cover member is configured to define an opening between the top of the cover member and the top wall of the housing.

3. The display case as recited in claim 1, wherein said tabs are coplanar with the cover member and are integral therewith.

4. The display case as recited in claim 3, wherein the bottom portion of said cover member is angularly disposed to the plane of the cover member to facilitate dispensing of articles.

5. The display case as recited in claim 4, wherein said cover member comprises transparent plastic.

* * * * *